US008403177B2

(12) United States Patent
Kwasny

(10) Patent No.: US 8,403,177 B2
(45) Date of Patent: Mar. 26, 2013

(54) PRESSURIZED DISPENSER FOR MIXING AND PRODUCING TWO-COMPONENT MATERIALS

(75) Inventor: Peter Kwasny, Schaffhausen (CH)

(73) Assignee: Peter Kwasny GmbH, Gundelsheim (DE)

( * ) Notice: Subject to any disclaimer, the term of this patent is extended or adjusted under 35 U.S.C. 154(b) by 797 days.

(21) Appl. No.: 10/539,459

(22) PCT Filed: Dec. 19, 2003

(86) PCT No.: PCT/EP03/14662
§ 371 (c)(1),
(2), (4) Date: Apr. 6, 2006

(87) PCT Pub. No.: WO2004/056660
PCT Pub. Date: Jul. 8, 2004

(65) Prior Publication Data

US 2006/0201969 A1 Sep. 14, 2006

(30) Foreign Application Priority Data

Dec. 19, 2002 (DE) ..... 102 60 117

(51) Int. Cl.
*B67D 7/74* (2010.01)

(52) U.S. Cl. ..... 222/83; 222/135; 222/394; 206/219; 206/222

(58) Field of Classification Search ..... 222/135, 222/83, 402.1, 80, 91, 85, 81, 394; 215/214, 215/232; 206/219, 222
See application file for complete search history.

(56) References Cited

U.S. PATENT DOCUMENTS 2,786,769 A * 3/1957 Greenspan ..... 426/117
3,240,391 A * 3/1966 Garton ..... 222/80
3,425,589 A * 2/1969 Considine et al. ..... 220/304
4,613,061 A * 9/1986 Meuresch et al. ..... 222/82
4,750,165 A * 6/1988 Champagne et al. ..... 370/276
(Continued)

FOREIGN PATENT DOCUMENTS

JP 63236556 10/1988
JP 2001171762 6/2001
(Continued)

OTHER PUBLICATIONS

WO 02/76852 English translation.*
(Continued)

*Primary Examiner* — Kevin P Shaver
*Assistant Examiner* — Robert Nichols, II
(74) *Attorney, Agent, or Firm* — Kenyon & Kenyon LLP

(57) ABSTRACT

Pressurized can comprising a body (2), a dome (3) accommodating a valve (4), a concavely shaped bottom (5), an inner casing (7) attached to a cup (6), a push rod (9) arranged in the inner casing (7), said push rod (9) being actuated through the cup (6) and intended to force open the inner casing (7), with said inner casing (7) being joined to the cup (6) via a spring cage (11), said spring cage (11) containing a spring-loaded trigger (12) which acts on the push rod (9) which, in turn, acts on a cover (8) arranged at the can-side end of the inner casing (7), said cover (8) being a membrane which seals the inner casing (7) at its can-side end hermetically against the contents of the pressurized can (1) and which is torn open by the push rod (9) when the trigger (12) is actuated.

21 Claims, 5 Drawing Sheets

U.S. PATENT DOCUMENTS

| | | | | |
|---|---|---|---|---|
| 4,769,395 | A * | 9/1988 | Pauls | 521/99 |
| 4,962,853 | A * | 10/1990 | Hildebrandt | 206/222 |
| 6,148,996 | A | 11/2000 | Morini | |
| 6,305,576 | B1 * | 10/2001 | Leoncavallo | 222/83.5 |
| 6,533,113 | B2 * | 3/2003 | Moscovitz | 206/222 |
| 7,270,233 | B2 * | 9/2007 | Kindt | 206/219 |
| 2004/0144808 | A1 | 7/2004 | Kwasny et al. | |
| 2007/0251954 | A1 * | 11/2007 | Fazekas et al. | 222/135 |

FOREIGN PATENT DOCUMENTS

| | | | |
|---|---|---|---|
| WO | WO 98/15463 | | 10/1997 |
| WO | WO 02/76852 | * | 3/2001 |
| WO | WO 02/076852 | * | 10/2002 |

OTHER PUBLICATIONS

English translation of WO 02/076852, published Oct. 3, 2002.*

* cited by examiner

FIG. 3
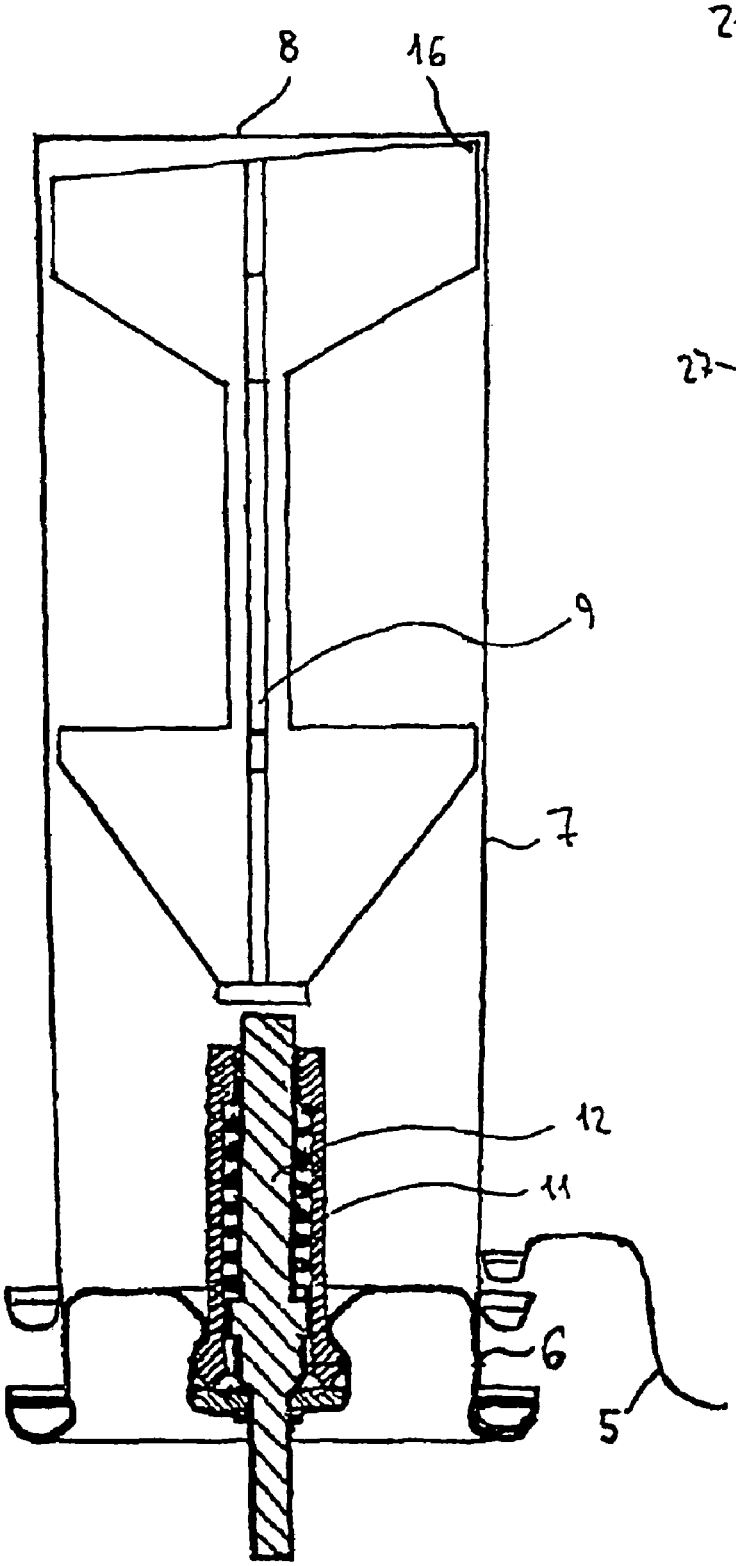
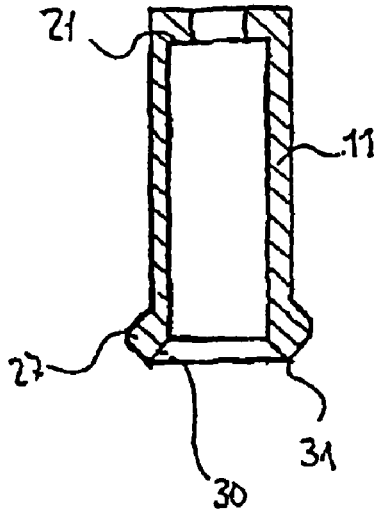
FIG. 4
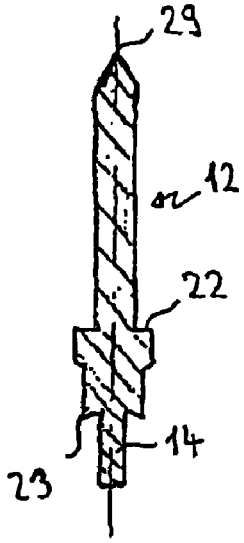
FIG. 5

PRESSURIZED DISPENSER FOR MIXING AND PRODUCING TWO-COMPONENT MATERIALS

The invention relates to a pressurized can comprising a body, a dome accommodating a valve, a concavely shaped bottom, an inner casing attached to a cup, a push rod arranged in the inner casing, said push rod being actuated through the cup and intended to force open the inner casing, with said inner casing being joined to the cup via a spring cage, said spring cage containing a spring-loaded trigger which acts on the push rod which, in turn, acts on a cover arranged at the can-side end of the inner casing, as well as to the use of such pressurized cans for two-component systems. Such pressurized cans are especially suited for packaging and dispensing two-component sealing and insulating foams, two-component glues and two-component coatings.

The invention relates in particular also to the design of pressurized cans which, in addition to the liquid substances of the main component, accommodate a second component in the inner casing, which second component reacts with the main component to form the finished product, e.g. a multi-component coating. Furthermore, the invention can also be used for two-component formulations that are intended for other purposes, e.g. for treating or finishing surfaces or generating plastic foams.

The substances of the main component contained in the pressurized can are liquid and consist, for example, of a curable coating binder, solvents and the liquid propellant that serves to dispense the component. The second component is contained, in a relatively small quantity, in the inner casing and consists, in most cases, of a compound which reacts quickly with the main component; the second component of a two-component system may be polyisocyanate/polyol, for example. Catalysts may be present, where appropriate. The component contained in the inner casing serves to influence the curing process and the quality of the product, usually by accelerating the curing reaction, increasing the product's strength or weathering resistance, etc. Just before the foam is dispensed, the second component is usually released into the pressurized can, as the cover of the inner casing is forced open, and is mixed with the main component by shaking the can.

A pressurized can with a one-piece bottom formed from a metal part is known from DE 82 27 229 U. The externally threaded neck of an additional container is placed in a cut-out in this bottom and clamped in position between a shoulder of the additional container and the inner rim of the bottom cut-out with the help of a nut screwed on from outside and an O-seal compressed by the action of the nut. The rod inside the additional container, which is provided with and protected by, a piston-shaped seal, is designed as a shaft that turns, and is supported, inside the additional container neck. When the shaft is driven from outside, its inner end positively engages with the cover of the additional container, forcing it off against the internal can pressure.

The base of the invention is WO 85/00157 A, which describes a pressurized can for dispensing single- or multi-component substances, which can is provided, in its interior, with an additional container accommodating a further component. The inner container is provided with an inner cover which can be forced open by a rod extending inside the inner container from the bottom of the pressurized can. The rod is movably supported inside the additional container and introduced through a seal arranged in the beaded cup of the can bottom. A pressurized can according to WO 85/00157 A is shown in FIG. 1.

The two pressurized cans according to the prior art are provided with an inner casing which is usually made from polyolefins, the preferred material being polypropylene. These plastic materials have, in general, proved successful, but have a disadvantage in that they are permeable to some propellant components and provide inadequate resistance to solvents, such as esters, cetons and aromatics. However, such solvents are usually contained in two-component coatings, which made it difficult in the past to package them in two-component pressurized cans. Moreover, manufacturing these cans is relatively difficult and cost-intensive, given the large number of single parts involved and the complexity of the can design. Leakage problems related to the materials used and especially to the interaction between metals and plastics are frequently experienced. These problems are difficult to control and repeatedly lead to faulty production lots.

The pressurized can according to WO 02/076852 A1 describes a somewhat improved design of the inner casing and solves the leakage problem in the cup area through the use of an attached membrane or by integrating the cup into the inner casing, so that there is no longer any need for seals in this area. However, the inner casing is still provided with a conventional cover that requires an O-seal for tightness. Thus, especially in the case of two-component coating systems, which use aromatics as solvents and polyisocyanates as the second component, the two components migrate, in not insignificant quantities, into the sealing system, especially when storage times are long and/or temperatures are high, which may lead to problems in forcing off the cover.

So the objective of the invention is to optimize the known pressurized cans to make sure that the inner casing forms one unit that is absolutely tight to the contents of the pressurized can.

This objective is achieved through the use of a pressurized can of the type mentioned above, in which the cover is a membrane. which hermetically seals the inner casing at its can-side end against the contents of the pressurized can and is torn open when the trigger is actuated by the push rod.

According to the invention, the inner casing is provided, at its can-side end, with a membrane that perfectly seals this critical area against the remaining can contents without the use of separate conventional sealing elements such as O-seals. The membrane may be glued to the inner casing or form an integral part of it, which means that the inner casing and the membrane are a one-piece design. In the case of a glued-on membrane, the membrane itself is preferably provided, around its circumference, with a skirt which—with the membrane placed on the inner casing—extends over of the rim of the casing and, say, a few millimetres down its outer wall and is tightly glued in place. Alternatively the skirt may be provided with an internal screw thread which, at the can side, is screwed on to an external thread provided on the inner casing; in this case, too, the sealing action is obtained through the use of glue.

The glues used in the invention are, in particular, conventional two-component glue systems, for example amine-hardening epoxy glues or amine- or OH-hardening polyisocyanate glues. The selection of the glue is governed by its resistance to the specific can contents; the most suitable glue may be determined by simple testing.

The inner casing used in the pressurized cans of the invention may be manufactured from customary materials, but are preferably made of aluminium. Plastic variants, e.g. polypropylene, are also suitable. However, where the inner casing forms an integral part of the bottom cup and where cans are pressurized using high pressure levels, an adequately pressure-resistant material must be used, preferably aluminium.

Tinplate may also be used. The technologies employed to manufacture the relevant plastic and metal parts are basically known to a skilled person.

In the variant of the invention using a membrane glued to the inner casing, the latter is connected to the bottom cup or valve cup of the pressurized can by means of a spring cage. The bottom cup is preferably a cup of the type used at the valve-side end of the pressurized can for the purpose of integrating the valve unit into the can dome. Manufacturing such cups is very simple and costs little. This provides an advantage in that there is no need to manufacture separate bottom cups. A particularly preferable embodiment is one in which the inner casing is arranged on the valve cup in the dome of the can, in which case a bottom cup is not required.

The inner casing with its membrane is connected to the cup by means of a spring cage. For this purpose, the inner casing may, for example, have a receptacle at its cup-side end which serves to secure the inner casing in a positive and/or non-positive manner to the spring cage. Expediently, the receptacle and the spring cage are clinched or crimped together and, with a view to optimizing the connection, the spring cage may have a circumferential projection or a circumferential groove, over or into which the receptacle is placed. Sealing elements are not required, as the membrane safely prevents the can contents from entering the inner casing. Expediently, a second attached membrane is placed in the transition area from the inner casing to the receptacle, whose function is described below.

The spring casing accommodates a spring-loaded trigger which acts on the second membrane and—through it—on the push rod arranged inside the inner casing. The cup-side end of the trigger—called trigger pin—projects through the cup from the pressurized can. The pin and the trigger may form one unit, but are separate parts when the inner casing is arranged on the valve cup; in this case, the trigger has a receptacle into which the pin is placed to open the inner casing and which is replaced by a valve after the inner casing has been opened. The spring deflection is such that the trigger safely moves the push rod up against the (first) membrane of the inner casing, thus tearing it open. For this purpose a deflection of approx. 5 to 10 mm is, in general, fully sufficient; the trigger pin projects by the same distance from the cup bottom. To actuate the push rod, the can with the pin is pushed against a flat, firm surface or the pin is pushed in with a hand.

Providing the spring casing with at least one cut-out is of advantage, as this will facilitate pressure compensation between the can space and the inner space of the spring casing. In an embodiment where the inner casing is arranged on the valve cup, these cut-outs serve also the purpose of enabling the pressurized can to be quickly filled with propellant through the spring cage. The filling operation takes place at pressures of up to 60 bar. To prevent untimely actuation of the inner casing due to the membrane being damaged during filling, fast depressurization must be possible. This is ensured by the cut-outs whose total cross section in relation to the free cross section of the filling device should expediently be comprised between ratios of 3 to 1 and 6 to 1.

The membranes of the inner casing thus safely seal the contents of the inner casing against the remaining can contents during storage of the can. After the can has been actuated by the action of the trigger pin, the second membrane is pierced. At the same time, the push rod tears open the first membrane of the inner casing, thus releasing the casing contents so that it can mix with the can contents. For this purpose, it is expedient to provide the can with a mixing aid which may take the form of a freely moving steel ball inside the can.

In the alternative embodiment of the pressurized can of the invention, the inner casing is additionally secured to the bottom cup. In this case, the spring cage is arranged inside the inner casing, on the inner side of the bottom cup. The trigger can be operated through the bottom cup by means of a pin and—without having to pierce a membrane—acts directly on the push rod, which pierces the membrane in the manner described above. In this case, too, the inner casing is hermetically sealed against the pressurized can contents, since the membrane and the inner casing form one unit. At the bottom end, the hermetic seal is obtained by crimping the inner casing to the concavely shaped bottom and the bottom cup, with a suitable sealing compound placed in the crimped joint.

It goes without saying that, in this alternative embodiment, the inner casing and the (first) membrane may also be glued together, as described above.

In both embodiments, the spring cage is retained in a central pocket of the cup. This pocket encloses the outwardly bulged bottom-side end of the spring cage, thus preventing the spring cage from moving with the pin/trigger as it moves into the can.

In an expedient embodiment, the push rod is equipped with several wings, four wings in particular, arranged on a central axis. The wings serve to stabilize the push rod inside the inner casing without the need for a push rod of unduly large volume. In order to further reduce the volume of the push rod, recesses or cut-outs may be provided. As the push rod and the trigger are separate units, at least in the case of the first variant, specific means for guiding and stabilizing the push rod are indispensable.

To facilitate the piercing of the membrane and obtain the largest possible opening cross, it is expedient to design the membrane-side end of the push rod in the shape of a sloped and sharp-edged hollow cylinder, providing it with a pointed tip, if necessary. Thus a first point of contact between the push rod and the membrane is created at the push rod periphery, and the membrane is first perforated at this point and, as the push rod progresses, a roughly circular opening is stamped or cut out from the membrane.

As the inner casing is hermetically sealed against the remaining can contents and as it is filled separately, there is bound to be a pressure difference between the can contents and the contents of the inner casing. Thus pressure is exerted on the membrane, causing it to bulge out into the inner cylinder; as a result the membrane contacts the push rod at the point that is nearest to the membrane. This membrane/rod contact contributes to piercing a large-size hole into the membrane.

As already outlined, the push rod is expediently sloped at its membrane-side end, thus forming a most nearest point to the membrane. Furthermore, the push rod is provided with four wings inside the inner casing for stabilization. This four-wing variant is usually sufficient to tear open the membrane after the trigger has been actuated. Due to this design, a cross-shaped cut is made in the membrane, causing the membrane to tear fully open as pressure from the can contents is exerted on it, so that the two components can quickly mix.

In both embodiments, there is a seal between the spring cage and the cup in the area of the central pocket. The spring cage crimped in place in the central pocket acts on the seal, thus preventing the can contents from exiting through the cup. The seal—for instance a rubber seal—is shaped as a punched circular disk, with the pin of the trigger projecting from the pressurized can through the central hole. The trigger has a projection at its cup-side end which, expediently by means of a salient edge, acts upon the punched disk in the cup, providing a seal to the outside in the pin area as well.

On the cup side, directly adjacent to the seal projection, the trigger is provided with a further projection, which acts as an abutment for the helical spring arranged inside the spring cage. An inner projection on the valve-side end of the spring cage serves as a further abutment. The spring ensures that the trigger rests safely with its seal ring against the seal rubber, while permitting the pin to be pushed in by the desired distance in order to actuate the inner casing.

In all other respects, the pressurized can of the invention is manufactured and equipped in the same manner as a conventional can. This applies in particular to the valve area and the valve-end equipment, which permits the pressurized can to be used both manually and—as a cartridge—with a spray gun.

Below is a description of the invention based on the attached drawings, which show the following.

FIG. 3 shows an inner casing for the pressurized can of the invention according to a second embodiment;

FIG. 4 shows a spring cage for the pressurized can of the invention; and

Figure 6:
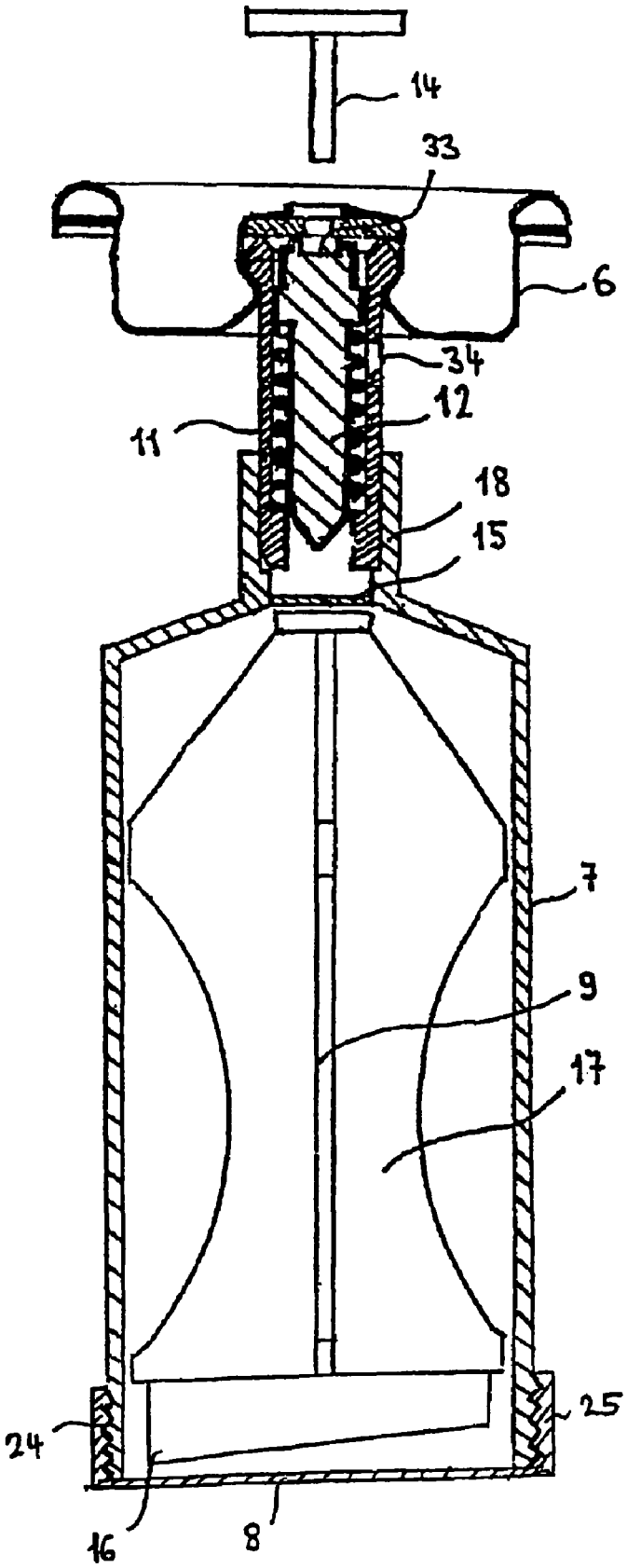
Figure 7:
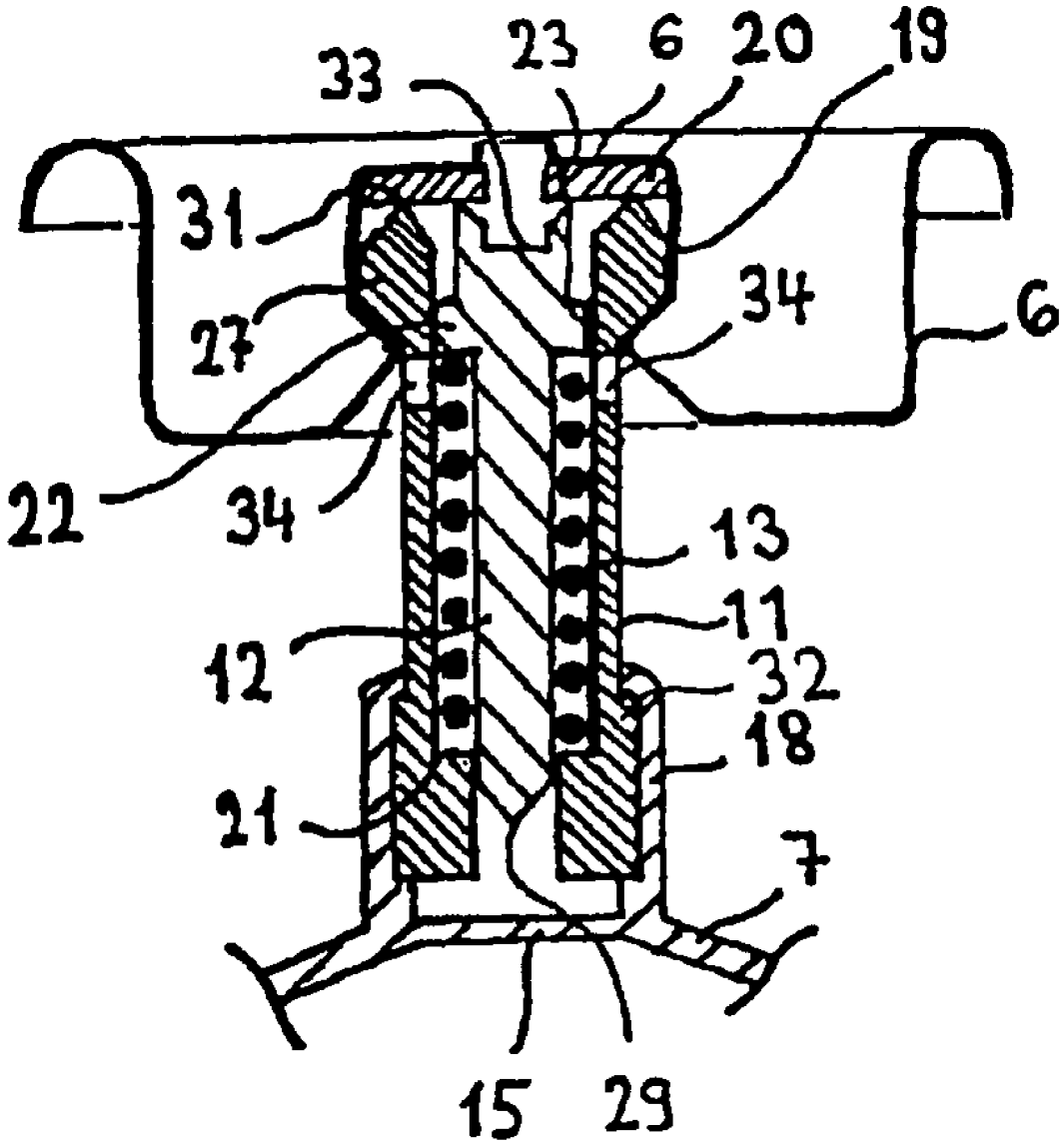

FIG. 5 a trigger for the pressurized can of the invention;

FIG. 6 shows an inner casing for the pressurized can of the invention for arrangement on a valve cup; and FIG. 7 a cup area of the embodiment according to FIG. 6.

FIGS. 1 to 7 are sectional drawings.

Figure 1:
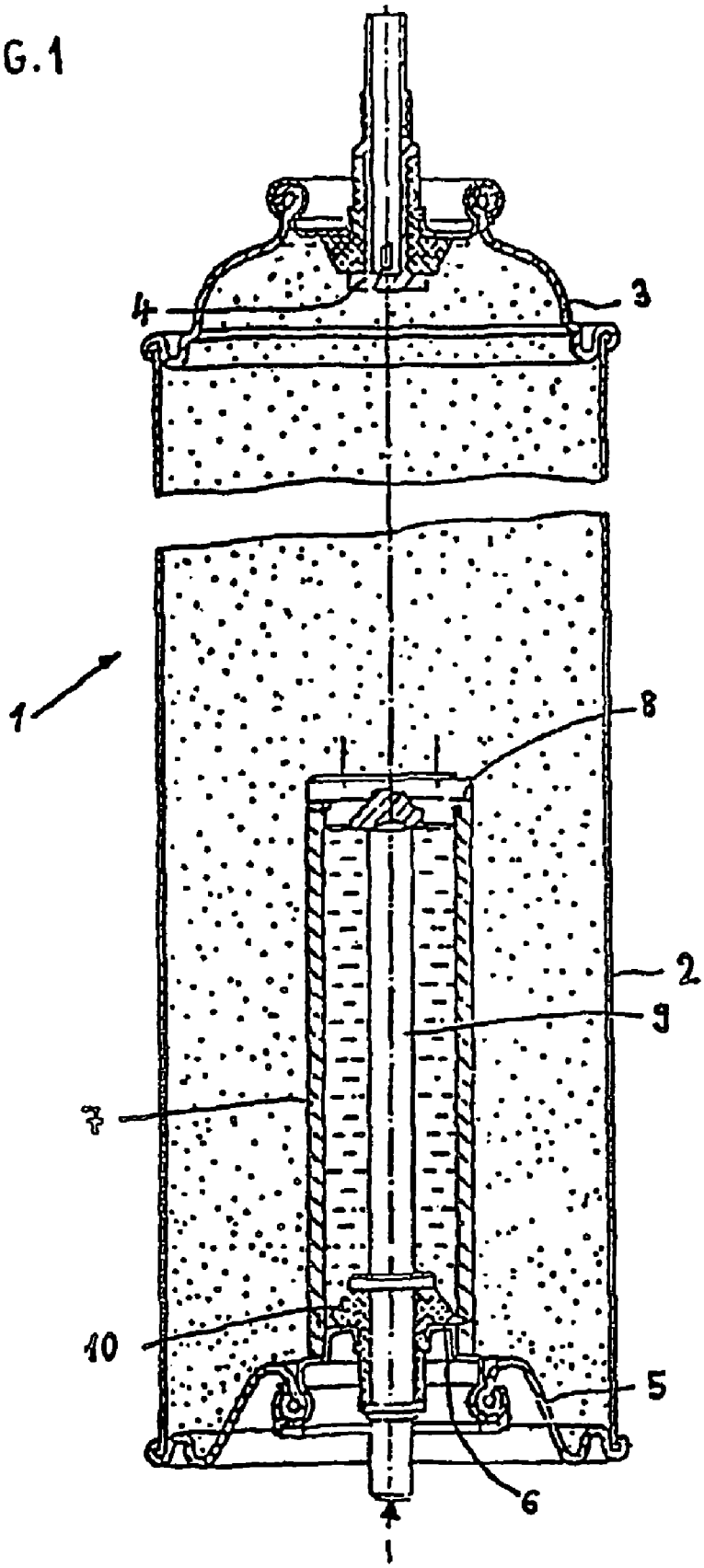
FIG. 1 shows a pressurized can with an inner casing according to WO 85/00157 A.

The pressurized can 1 according to FIG. 1 consists of a body 2, which is closed with a dome 3 at its upper end. The dome 3 is connected to the body by means of interlocked flanges which provide also a tight seal between these components. The dome 3 is made from a round blank cut from sheet metal and formed into the domed shape shown on the drawing. The inner rim of the dome 3 is also provided with a flange by which it is joined to a valve cup holding a valve 4.

The bottom 5 is also joined to the body 2 by means of interlocked flanges and is equipped, in its centre, with a bottom cup 6, above which the inner casing 7 is located. The inner casing 7 is provided with a cover 8 that can be forced off. Inside the inner casing 7, there is a push rod 9, whose end projects through a sealing element 10 from the bottom of the pressurized can. On both sides of the sealing element 10, the push rod 9 is equipped with stops, both of which act on the sealing element 10 and limit the free travel of the push rod 9 inside the inner casing 7. To force open the cover 8 from within the inner casing 7, the push rod 9 is pushed in by hitting the can bottom against a firm surface, causing the push rod to move upwards. The rubber-elastic sealing element 10 absorbs the upward movement and, once the cover 8 has been forced off, pushes the push rod 9 back into its initial position.

Figure 2:
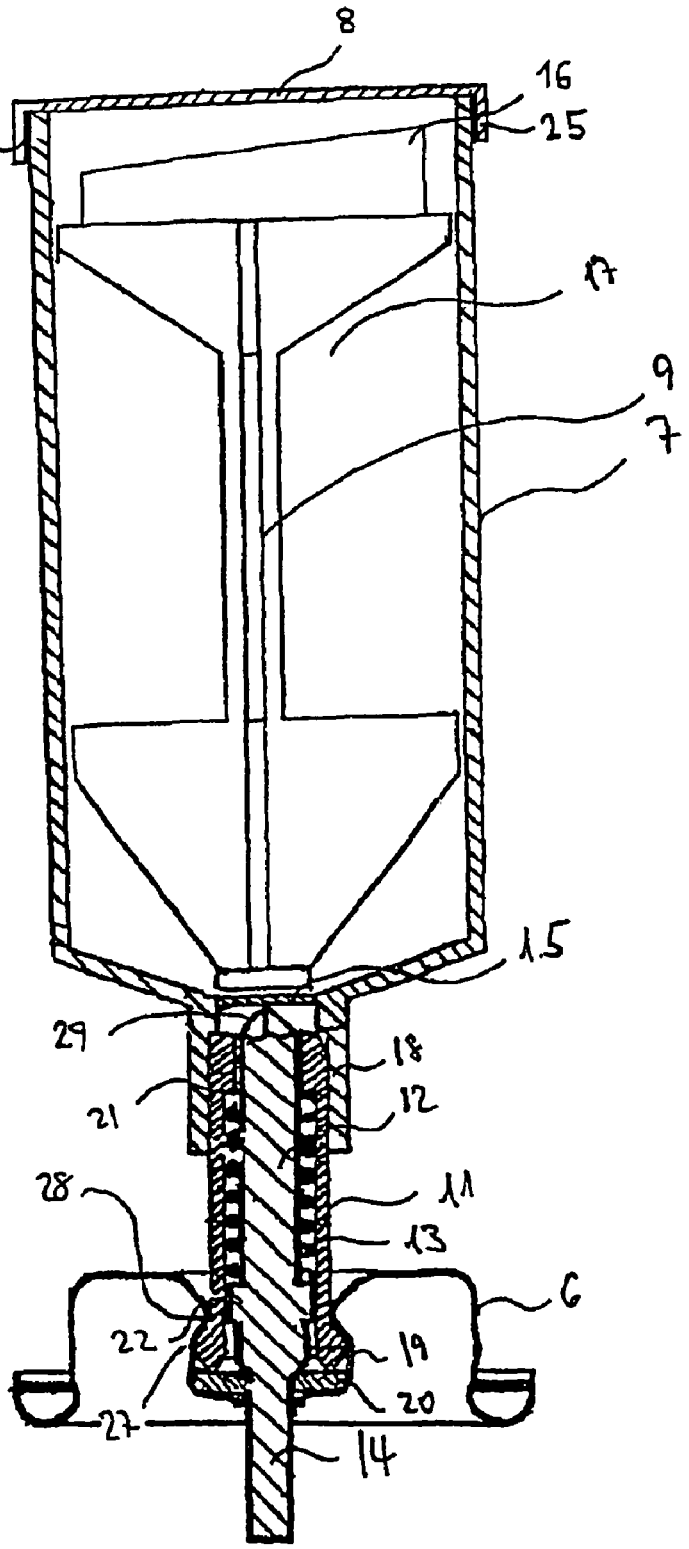
FIG. 2 shows an inner casing for the pressurized can of the invention according to a first embodiment for arrangement on the bottom cup.

According to the invention, the can shown in FIG. 1 can be equipped with the inner casings shown in FIGS. 2, 3 or 6.

FIG. 2 shows an inner casing 7 with a push rod 9 and a cover 8 manufactured and used in accordance with the invention. The inner casing 7 has a cylindrical wall and is closed with a membrane at the cup end. Adjacent to the cup-side membrane, there is a cylindrical receptacle 18, which serves to connect the spring cage.

The inner casing may be made from a suitable plastic material, the more expedient material being aluminium, however. When aluminium is used, the suitable material thickness is approx. 0.3 to 0.8 mm for the wall and approx. 0.05 to 0.10 mm for the two membranes.

At the can end, the inner casing 7 is closed with a first membrane 8, which may be made from aluminium or plastic. The membrane 8 is provided with a circumferential skirt 25 which extends over and down the outer edge of the inner casing 7. Between the skirt 25 and the external wall of the inner casing, there is a continuous layer of a glue 24 that is resistant to the can contents (the contents of the outer can and the contents of the inner casing).

The push rod 9 arranged inside the inner casing 7 is provided with four wings 17, which have lateral cut-outs for the purpose of reducing their volume. At the cup end, there is a cup-shaped closure located on the can side directly adjacent to the second membrane 15. At the can end, the push rod 9 is sloped in such a manner that its most nearest point 16 to the membrane is located in the periphery; it is at this point that the membrane is first pierced when the push rod 9 is actuated. The sloped design of the push rod end 16 in the form of a hollow cylinder with sharp edges then causes a cylindrical opening to be stamped or cut out from the membrane 8.

The spring cage 11 consists of a plastic casing which, at its can-side end, is provided with an inner circumferential projection 21, which acts as an abutment for a helical spring 13 arranged inside the spring casing. At the cup end, the helical spring 13 rests on a circumferential projection 22 of the trigger 12. In home position, the spring 13 exerts pressure on the trigger 12, so that the latter's sealing seat 23 is pressed against the seal ring 20 arranged inside the cup 6. At its end projecting from the cup 19, the trigger 12 ends in a pin 14, which projects from the can by the length that the trigger 12 must be pushed in to force open the cover 8 by means of the push rod 9.

At the cup end, the spring casing 11 has a bulge 27, which extends into the inner pocket 19 of the bottom cup 6 and holds the spring casing 11 securely in place inside the bottom cup 6. During its manufacture, the bottom cup 19, which is designed like the valve cup of a standard aerosol can, is crimped to the seal 20 and the spring casing 11 resting on it. The crimped joint provides a firm connection between the cup 6, the spring cage 11, and the rubber seal 20, due to the interaction between the recess 28 of the cup 6 and the bulge 27 of the spring cage 11.

The trigger 12 comprises a section located inside the spring cage and a projecting pin 14, which serves to initiate the triggering operation. A pointed tip 29 is located directly adjacent to the second membrane 15 and, when actuated, acts on the bottom end of the push rod 9. This causes the second membrane 15 to be pierced, allowing the contents of the inner casing to exit into the can and mix with the other component. At the cup end, directly adjacent to the abutment 22, there is a circumferential sealing seat 23 (FIG. 5), which projects relative to the pin 14 and whose salient edge acts on the seal 20.

FIG. 3 shows a second variant of the inner casing of a pressurized can according to the invention, in which the inner casing 7 and the membrane 8 are integrally connected with each other. Here, too, the inner casing 7 is completely sealed against the remaining can contents at both the can end and the cup end. The design and workings of the push rod 9 and the spring cage 11 are the same as in the arrangement shown in FIG. 2.

The embodiment according to FIG. 3 lacks the membrane 15. Thus there is no need for a pointed tip to be provided on the trigger 12 for the purpose of piercing the second membrane according to FIG. 2.

What is important to note is the fact that the inner casing 7 according to FIG. 3 is preferably manufactured in one piece, which means the inner casing 7 and the membrane 8 are not joined in a post-production operation. Here, too, the thickness of the casing 7 and the membrane 8 is in the region of between 0.3and 0.8 mm. However, the inner casing and the membrane may alternatively be joined by gluing or soldering.

At the bottom end, the inner casing 7 is crimped to both the bottom part 5 and the cup 6 using standard seals. The spring cage is secured to the bottom cup 6 in the manner described above.

The push rod 9 is designed with four wings to ensure that it is properly guided inside the inner casing 7, with the wings being cut out in the central area. At the membrane end, the four wings are full-size and evenly sloped to form a most nearest point 16 to the membrane, where the piercing of the membrane 8 starts when the trigger and the push rod push rod are actuated. The piercing operation is assisted by the pressure present inside the can—which is significantly higher than the pressure inside the inner casing—and by the fact that the membrane 8 bulges out into the inner casing, closely contacting the cross of the push rod 9 in the area of the most nearest point 16 to the membrane.

FIG. 4 shows a spring cage 11 which can be used in the invention; it is provided with a can-end abutment 21 for the helical spring arranged in the inner casing, and with a cup-end bulge 27 that serves to secure and crimp it to the bottom cup 6. This embodiment features, in addition to the bulge 27 shaped in the form of a circumferential bead, a bevel 30 on the inner edge and a circumferential edge 31, which is pressed with cup 6 against the rubber seal 20 during the crimping operation.

FIG. 5 finally shows a trigger 12 as used in the invention, which is provided with a pointed tip 29, the abutment 22 for the helical spring, the pin 14, and the sealing seat 23, which projects relative to the part of the trigger located inside the spring, and the pin 14, but is recessed relative to the abutment 22, said sealing seat 23 being provided with a circumferential edge that acts on the seal 20; in the sectional drawing, the sealing seat is slightly undercut.

FIG. 6 shows a further preferred embodiment of an inner casing 7 according to the invention, which is arranged at a valve cup 6.

The arrangement of the inner casing on the valve cup 6 provides an advantage in that the aerosol can does not require a specifically designed bottom area. At the cup end, the inner casing 7, with the push rod 9 and the cover 8, is provided with the second membrane 15, which hermetically seals the inner casing against the cup. Adjacent to the cup-end membrane, there is a cylindrical receptacle 18, which serves to join the inner casing to the spring cage 11.

At the bottom end, the inner casing 7 is equipped with a screwed-on membrane 8, whose external wall is provided with an internal thread which interacts with the external thread of the inner casing 7. The thread area is provided with a continuous layer of glue to ensure a hermetic seal.

With the exception of trigger area variants, the design of the inner casing according to FIG. 6 is identical with that shown in FIG. 2.

The inner casing 7, with its receptacle 18, is placed on the can-side end of the spring cage 11 and firmly connected to the latter to prevent detachment when the trigger 12 is actuated. The connection is expediently made by clinching the receptacle 18 to the spring cage 11, preferably by passing the free end of the receptacle 18 over an external circumferential projection 32 (see FIG. 7) of the spring cage 11.

Given the fact that, in the embodiment according to FIG. 6, the spring cage 11, with the trigger 12, forms part of the valve mechanism, it is expedient to physically separate the trigger 12 from the trigger pin 14. For this purpose, the trigger 12 is provided with a receptacle 33 for the trigger pin 14, which accommodates the trigger pin for the triggering operation, but from which the trigger pin can be withdrawn again after the triggering operation. The same receptacle subsequently accepts a conventional spray head as used on aerosol cans. So-called female valves having lateral slots and a stem extending into the receptacle 33 are preferred.

To facilitate the in-flow of the can contents into the spring cage and its further progression to the valve, it is expedient to provide at least one cut-out 34 in the spring cage itself. Following the actuation of the inner casing and the replacement of the trigger pin 14 with a spray head, the can contents can flow into the spring cage through the cut-out(s) 34 and be dispensed from the pressurized can through the valve 4.

The cut-outs 34 used in the embodiment according to FIG. 6 have a further function related to the filling of the can. After the can has been filled, the filled inner casing with the valve cup is placed on the can dome and crimped to it. Following this operation, the can is filled with a propellant introduced through the valve aperture, said propellant being normally propane, butane, dimethyl ether and/or chlorofluorocarbon (134*a*). To make the filling operation as short as possible, the cans are filled at a pressure of up to 60 bar. However, pressures of up to 60 bar hold the risk of the membrane 15 bursting, either due to the pressure itself or the action of the pressure-driven trigger 12. To counter this risk, the gas entering the can must be allowed to expand as quickly as possible. Such expansion is achieved by providing one or several cut-outs 34 in the spring cage 11. Expediently, these cut-outs 34 have a total cross section three to six times larger than the cross section of the filling needle, through which the propellant is introduced into the pressurized can.

The cut-outs 34 in the valve cage 11 are arranged at the cup-side end of the valve cage, preferably as near the valve as possible. The valve-end seal is formed by a sealing seat 23 at the cup-side end, which is shaped as a circumferential projection that acts on the seal 20 placed between the spring cage 11 and the cup 6 in the area of the central pocket 19. In comparison to the embodiment according to FIG. 2, it is expedient to place the trigger 12 farther away from the membrane 15 to ensure that, when the can is filled with propellant, a certain deflection of the trigger 12 can be accommodated without posing a threat to the membrane 15. It goes without saying that the distance from the trigger 12 to the second membrane 15 must be reflected in the length of the trigger pin 14, which means that the total length of the trigger pin must correspond to the distance from the trigger 12 to the membrane plus the distance which the push rod 9 must travel in order to pierce the membrane 8. The spring deflection is designed to meet this requirement.

FIG. 7 is a detailed representation of the spring cage with a trigger 12 according to FIG. 6. The valve cup 6 shows, in its central area, a pocket 19 with a cut-out, in which a seal 20, shaped as a punched disk and preferably made from a rubber-like material, is arranged on the can side. In the area of the pocket 19, the spring cage 11 is fixed in place by means of its bulge 27. The circumferential edge 31 arranged at the top acts on the rubber seal 20 and seals the can contents against the central opening in the cup and the seal 20. Due to the crimping operation by which the spring cage 11 is fixed in the central pocket 19 of the valve cup 6, the individual components are tightly connected in a positive and non-positive manner. The free end of the receptacle 18 extends over an external circumferential projection 32 of the spring cage 11.

The spring cage 11 is provided with cut-outs 34 arranged directly below the point where it is secured to the valve cup 6, which cut-outs allow the can contents to enter the spring cage. Inside the spring cage 11, there is the helical spring 13, which rests against an internal projection 21 of the spring cage 11 and an external projection 22 of the trigger 12. In relaxed condition, the helical spring 13 pushes the trigger with its circumferential edge 23 against the rubber seal 20, so that the pressurized can is closed in this condition.

To open the inner casing, the trigger pin 14 is placed in the recess 33 of the trigger 12 and strongly pushed downwards, so that the pointed tip 29 of the trigger 12 pierces the membrane 15, causing the push rod 9 arranged below said membrane to move downwards towards the membrane 8. Once the triggering operation is completed, the trigger 12 returns to its home position, leaving the can sealed towards the outside. During the triggering operation, the seal is ensured by the interaction of the flanks of the trigger pin and the rubber seal 20.

To dispense the can contents, a standard valve operated by a press-down mechanism, is placed in the recess 33. In this case the trigger travels a defined distance into the can, so that the can contents can freely flow through the cut-outs 34 into the spring cage and further through the valve.

The cut-outs 34 have the additional purpose of providing a quicker way for the propellant to enter the can contents when the closed can is filled with propellant through the central opening in the seal 20. In this operation, the propellant is introduced at a specified pressure into the spring casing through the seal 20, which causes the trigger 12 to travel a defined distance towards the membrane 15 without actually reaching it, so that—once the cut-outs 34 are open—the gas can expand sideways into the can.

Pressurized cans according to the embodiment as shown in FIG. 6 are used "top down", which means that the valve points downwards. Pressurized cans according to FIGS. 2 and 3 may be used upright in combination with a riser tube or "top down" without a riser tube. Using the cans with a spray gun is possible and constitutes an intended method of use.

It should be noted that the expressions "can end" and "can side" relate to an arrangement oriented towards the inside of the can, while "cup end" and "cup side" denote an arrangement that is oriented towards the cup (located either in the vale or bottom area).

The invention claimed is:

1. Pressurized can comprising a body (2), a dome (3) accommodating a valve (4), a concavely shaped bottom (5), an inner casing (7) attached to a cup (6), a push rod (9) arranged in the inner casing (7), said push rod (9) being actuated through the cup (6) and intended to force open the inner casing (7), with said inner casing (7) being joined to the cup (6) via a spring cage (11), said spring cage (11) containing a spring-loaded trigger (12) which acts on the push rod (9) which, in turn, acts on a cover (8) arranged at the can-side end of the inner casing (7), characterized in that a portion of the inner casing (7) defines the cover (8), wherein the cover (8) is a membrane integral with and forming one piece with the inner casing (7) which seals the inner casing (7) at its can-side end hermetically against the contents of the pressurized can (1) and which is torn open by the push rod (9) when the trigger (12) is actuated, wherein the pressure inside the inner casing (7) is lower than the pressure outside the inner casing (7) and said membrane is comprised of a material sufficiently flexible so that in response to the higher pressure outside the inner casing (7), said membrane bulges into said inner casing (7).

2. Pressurized can according to claim 1, characterized in that the inner casing (7) is provided, at its extreme end, with a receptacle (18) for securing it to the spring cage (11).

3. Pressurized can according to claim 2, characterized in that the receptacle (18) and a spring cage (11) are clinched together.

4. Pressurized can according to claim 3, characterized in that the free end of the receptacle (18) is placed over an outer circumferential projection (32) of the spring cage (11).

5. Pressurized can according to claim 1, characterized in that a second membrane (15) is arranged in the transition area from the inner casing (7) to the receptacle (18).

6. Pressurized can according to claim 1, characterized in that the inner casing (7) is arranged on a cup (6) located in the bottom (5) of the pressurized can (1).

7. Pressurized can according to claim 1, characterized in that the cup (6) with the inner casing (7) is arranged in the dome (2) of the pressurized can (1).

8. Pressurized can according to claim 7, characterized in that the trigger (12) is provided with a receptacle (33) for a trigger pin (14) or a spray head.

9. Pressurized can according to claim 1, characterized in that the inner casing (7) is secured to the cup (6) arranged in the bottom (5) of the can (1) and is provided with an attached membrane (8).

10. Pressurized can according to claim 9, characterized in that the inner casing (7) and the cup (6) are joined together by crimping.

11. Pressurized can according to claim 1, characterized in that the spring cage (11) is fixed in a central pocket (19) of the cup (6).

12. Pressurized can according to claim 11, characterized in that the trigger (12) is provided, at its cup-side end, with a peripheral projection (22) acting as an abutment for the spring element (13).

13. Pressurized can according to claim 1, characterized in that the push rod (9) is provided with several wings (17) along a central axis.

14. Pressurized can according to claim 13, characterized in that the push rod (9) has the shape of a sloped and sharp-edged hollow cylinder (16) at its can-side end.

15. Pressurized can according to claim 1, characterized in that the wings (17) are provided with cut-outs and/or recesses.

16. Pressurized can according to claim 1, characterized in that a seal (20) is arranged between the spring cage (11) and the cup (6) in the area of the central pocket (19).

17. Pressurized can according to claim 1, characterized in that the spring cage (11) is provided, at its valve-side end, with an internal projection (21) acting as an abutment for a spring element (13).

18. Pressurized can according to claim 1, characterized in that the trigger (12) is provided, at its cup-side end, with a sealing seat (23) having the form of a circumferential projection.

19. Pressurized can according to claim 1, characterized in that the inner casing (7) and the membrane (8) are made from aluminium.

20. Pressurized can according to claim 1, characterized in that the spring cage (11) is provided with at least one cut-out (34).

21. Use of the pressurized can according to claim 1 for liquid two-component systems, in particular two-component sealing foams, two-component glues or two-component coatings.

* * * * *

UNITED STATES PATENT AND TRADEMARK OFFICE

CERTIFICATE OF CORRECTION

PATENT NO. : 8,403,177 B2
APPLICATION NO. : 10/539459
DATED : March 26, 2013
INVENTOR(S) : Peter Kwasny It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1153 days.

Signed and Sealed this
First Day of September, 2015

Michelle K. Lee

Michelle K. Lee
*Director of the United States Patent and Trademark Office*